United States Patent [19]

Tanabe et al.

[11] Patent Number: 4,838,223

[45] Date of Patent: Jun. 13, 1989

[54] FUEL SUPPLY CONTROL APPARATUS FOR INTERNAL COMBUSTION ENGINES

[75] Inventors: Yoshiyuki Tanabe; Mineo Kashiwaya, both of Katsuta, Japan

[73] Assignee: Hitachi, Ltd., Tokyo, Japan

[21] Appl. No.: 162,083

[22] Filed: Feb. 29, 1988

[30] Foreign Application Priority Data

Mar. 6, 1987 [JP] Japan ..... 62-49983

[51] Int. Cl.[4] ..... F02D 41/08

[52] U.S. Cl. ..... 123/339; 123/478; 123/480

[58] Field of Search ..... 123/339, 340, 480, 486, 123/585, 350, 399, 478

[56] References Cited

U.S. PATENT DOCUMENTS 4,491,108 1/1985 Hasegawa et al. ..... 123/339

4,577,603 3/1986 Murakami et al. ..... 123/339

4,625,281 11/1986 Deutsch ..... 123/339

FOREIGN PATENT DOCUMENTS 59-82546 5/1984 Japan ..... 123/339

59-194051 11/1984 Japan ..... 123/339

*Primary Examiner*—Andrew M. Dolinar

*Attorney, Agent, or Firm*—Antonelli, Terry & Wands

[57] ABSTRACT

When auxiliary equipment of a car, such as car air conditioner, is required to operate, fuel to be supplied for an engine is at first increased and at a predetermined time thereafter additional air commensurate with the increment of fuel is supplied, and after the engine increases its output power by the above mentioned increase of fuel and air, the auxiliary equipment is actually operated, whereby the number of revolutions of the engine is prevented from decreasing.

7 Claims, 3 Drawing Sheets

FUEL SUPPLY CONTROL APPARATUS FOR INTERNAL COMBUSTION ENGINES

BACKGROUND OF THE INVENTION

1. Field of the Invention

The present invention relates to a fuel supply control apparatus for an internal combustion engine, more particularly to a control apparatus capable of adequately controlling the increment of fuel mixture to be supplied so as to compensate the increase of load, which is required of the engine, when auxiliary equipment of a car, such as a car air conditioner, headlights, a power steering device and so on, operates.

2. Description of the Related Art

When an internal combustion engine is burdened with increased load, a number of revolutions of the engine decreases, unless the engine is controlled so as to increase its output power. The number of revolutions is remarkably decreased especially during a time when the output power of an engine is small, as in the idling state thereof. In order to prevent the decrease of a number of revolutions, there has been proposed a control apparatus as disclosed in U.S. patent application Ser. No. 105,913 (filed Oct. 8, 1987 and assigned to the assignee of the present application), for example. According to the prior art described above, when a relatively large load is put on an engine during the idling state thereof, i.e., when a driver turns on a switch for operating a car air conditioner, for example, the control apparatus produces an actuating signal to a by-pass valve for supplying additional air for the engine by by-passing a throttle valve which is closed in the idling state. An actuating signal having a different value is stored in advance in a table within the control apparatus for every kind of load, and it is read out therefrom in response to a load required. Namely, an actuating signal produced by the control apparatus corresponds to a kind of auxiliary equipment required to operate. The opening degree of the by-pass valve is determined accordingly, and additional air is introduced into the engine through the by-pass valve.

After that, an amount of fuel to be increased in response to introduction of the additional air is also retrieved from another table within the control apparatus with the aforesaid actuating signal, and then fuel according to the retrieved amount is supplied for the engine, so that the fuel is increased commensurately with the amount of the additional air. As a result, the output power of the engine is increased and hence the number of revolutions thereof is prevented from decreasing.

The prior art control apparatus as described above has the following drawback. When a switch for requiring auxiliary equipment to operate is turned on, the auxiliary equipment is actuated immediately, but the fuel mixture, the flow rate of which is increased so as to compensate for the increase in load caused by operation of the auxiliary equipment, reaches the engine at a later time. As a result, a number of revolutions of the engine decreases temporarily, and the operational condition of the engine becomes unstable.

SUMMARY OF THE INVENTION

An object of the present invention is to provide a fuel supply control apparatus for an internal combustion engine, which can prevent the number of revolutions of the engine from temporarily decreasing, when auxiliary equipment of a car is required to operate.

A feature of the present invention resides in that when auxiliary equipment is required to operate, the amounts of increments in fuel and air to be supplied for an engine are determined in response to a kind of the auxiliary equipment required to operate, the fuel and air supplied for the engine are increased in accordance with the determined incremental amounts thereof, and after an output power of the engine reaches a predetermined value, an actuating instruction is given to the auxiliary equipment.

With the feature of the present invention, as described above, when auxiliary equipment is required to operate, the output power of an engine is at first increased and thereafter the required auxiliary equipment is operated. Therefore, a decrease in the number of revolutions of the engine, which is caused by an increase in the load due to the operation of the auxiliary equipment, can be prevented.

According to one of the embodiments of the present invention, fuel increased in accordance with the determined increment thereof is at first supplied for an engine and then additional air is introduced in response to the determined increment of fuel. With this, there is solved a problem caused by the difference in the so-called transportation delay between fuel and air. If the time duration between supply of increased fuel and that of additional air is changed, the present invention is advantageously applicable to every type of an engine.

In accordance with another embodiment of the present invention, an actuating instruction is given to auxiliary equipment required to operate after a predetermined time following supply of additional air for an engine. With this time duration, the engine can surely increase its output power sufficiently to accommodate the burden of increased load. Especially, in the idling state of the engine, the actuating signal can be given to the auxiliary equipment when the number of revolutions of the engine reaches a predetermined value. dr

DESCRIPTION OF THE PREFERRED EMBODIMENTS

In the following, an embodiment of the present invention will be explained with reference to the accompanying drawings.

Figure 1:
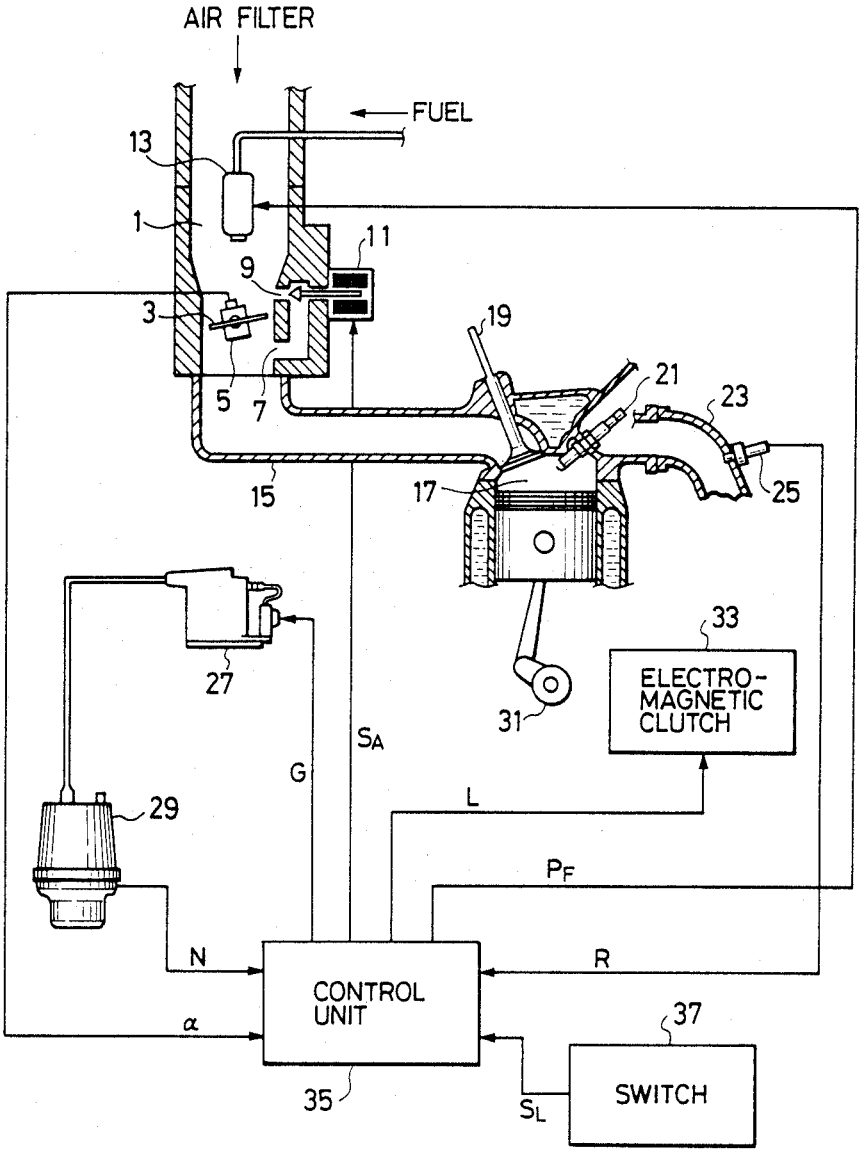
FIG. 1 schematically shows an overall configuration of a fuel supply control apparatus according to an embodiment of the present invention.

Referring to FIG. 1, there is shown an overall configuration of a fuel supply control apparatus according to an embodiment. In a throttle chamber 1, there is provided a throttle valve 3, the opening of which is detected by a throttle sensor 5. The sensor 5 produces a signal $\alpha$ representative of the opening degree of the throttle valve 3.

There is provided a by-pass 7 in such a manner that the throttle valve 3 is bridged from upstream to downstream. In a part of the by-pass 7, there is equipped a by-pass valve 9, the opening of which is controlled by a solenoid coil 11 in response to an actuating signal $S_A$ applied thereto to control the amount of air flowing through the by-pass 7. The actuating signal $S_A$ is called an air increment signal, hereinafter.

A fuel injector 13 is equipped upstream of the throttle valve 3, for which pressure-regulated fuel is supplied. A valve of the injector 13 is opened in accordance with a signal $P_F$ applied thereto to inject fuel into the throttle chamber 1. The signal $P_F$ is given in the form of the opening time duration of the valve of the injector 13, and the amount of fuel injected depends on the existing time duration of the signal $P_F$, because the pressure of fuel supplied for the injector 13 is regulated constantly.

The injected fuel is mixed with air supplied from an air filter (not shown). Air/fuel mixture is transported through an intake pipe 15 and introduced into a combustion chamber 17 when an inlet valve 19 is opened. The introduced mixture is ignited by an ignition spark plug 21, and exhaust gas is discharged through an exhaust pipe 23 when an outlet valve (not shown) is opened. There is an oxygen sensor 25 mounted on the exhaust pipe 23, which detects the concentration of oxygen remaining in the exhaust gas and produces an A/F ratio signal R proportional to an air/fuel ratio of the fuel mixture supplied.

High voltage applied to the ignition spark plug 21 is generated by an ignition coil 27 in response to a timing signal G and distributed by a distributor 29 to the ignition spark plug 21 of respective cylinders. From the distributor 29, a signal N proportional to a number of revolutions of the engine is also derived.

As shown in the figure and described above, in this embodiment, the present invention is applied to an internal combustion engine of a so-called single point injection (SPI) type, in which a single injector is provided upstream of the throttle valve 3 and injects fuel for all cylinders. The injection type is not confined to the SPI type, but may be in the form of another SPI type, in which there is provided a single injector downstream of a throttle valve, a multi-point injection (MPI) type, in which an injector is mounted on each branch pipe connected to each cylinder, or a division-type SPI, in which the intake system is divided into plural groups downstream of a throttle valve with a single injector allocated to each group.

Further, in the following description, let us take a car air conditioner as an example of auxiliary equipment. A compressor (not shown) of the air conditioner is coupled with a crank shaft 31 through an electromagnetic clutch 33. When the electromagnetic clutch 33 is energized in response to an actuating signal L applied thereto, torque being produced at the crank shaft 31 is transmitted to the compressor so that the air conditioner operates. At that time, the engine is burdened with load increased in correspondence to the power necessitated by the compressor.

The control apparatus comprises a control unit 35 having a built-in microprocessor, which processes the opening degree signal $\alpha$, the number-of-revolution signal N and the A/F ratio signal R sent from the respective sensors and outputs the ignition timing signal G, the air increment signal $S_A$, the fuel supply signal $P_F$ and the actuating signal L.

The microprocessor is constructed in the same manner as a microprocessor of this kind conventionally used. Namely, it has a central processing unit (CPU) for executing predetermined processing programs, a read-only memory (ROM) for storing the programs and various constants necessary for the processing operation in the CPU, and a random access memory (RAM) for temporarily storing signals detected by various sensors as described above, and variables necessary for and results in the processing operation in the CPU. There are further provided various input/output interface. These constituent elements are interconnected by known buses.

The control unit 35 is also supplied with a signal $S_L$ from a switch 37. In the present embodiment, the switch 37 is a switch for requiring a car air conditioner to operate, which is manipulated by a user when he wants to operate it.

The control unit 35, first of all, determines the basic amount of fuel to be supplied for the engine on the basis of the opening degree signal $\alpha$ and the number-of-revolution signal N. There are various methods of determining the basic amount of fuel to be supplied. The basic amount $Q_F$ of fuel can be calculated in accordance with a predetermined formula of $Q_F = f(\alpha, N)$, or it is determined by retrieving values from a table prepared in advance in a storage within the control unit 35 on the basis of $\alpha$ and N.

The thus determined basic amount of fuel to be supplied is corrected in accordance with the A/F ratio signal R to produce the fuel supply signal $P_F$, by which an actual A/F ratio of the fuel mixture is maintained at a predetermined value. Further, as already described, the fuel supply signal $P_F$ is produced in the form of a time duration $T_i$ during which the valve of the injector 13 is opened.

The method as described above, in which the amount of fuel to be supplied is determined on the basis of the opening degree of the throttle valve and the number of revolutions of the engine, is called an $\alpha$-N fuel control method, which is one of methods simpler than a well known $Q_a$-N fuel control method, in which the amount of fuel to be supplied is determined on the basis of the amount $Q_a$ of suction air detected by an airflow sensor and the number N of revolutions of the engine. The method of determining the amount of fuel to be supplied is not confined to the $\alpha$-N fuel control method as described above, but may be in the form of the $Q_a$-N fuel control method.

Figure 2:
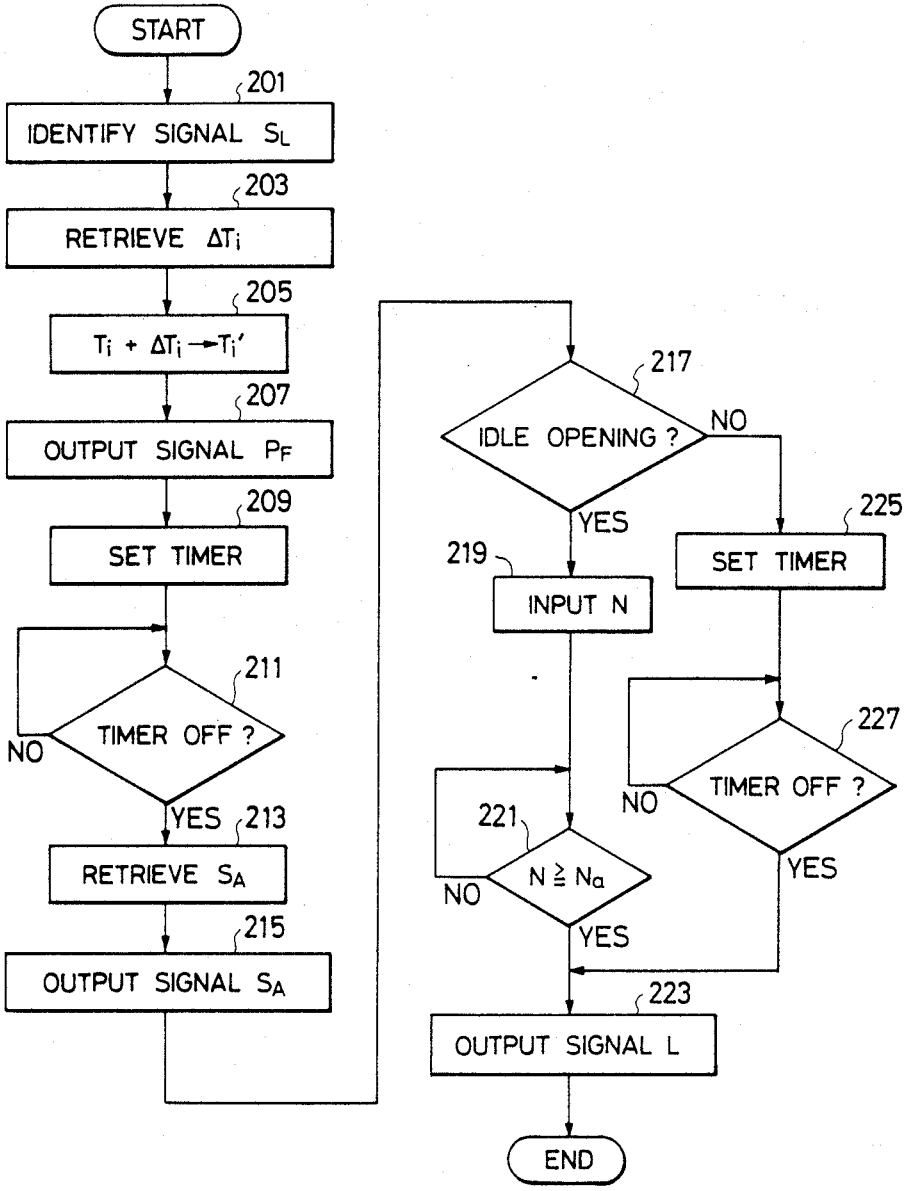
FIG. 2 shows a flow chart of the processing operation executed by a microprocessor built in a control unit included in the fuel supply control apparatus of FIG. 1.

In the following, the description will be given of the operation of the control unit 35, which is characterized by the present invention, with reference to the flow chart of FIG. 2.

When the switch 37 for auxiliary equipment is manipulated, there occurs an interrupt signal and the processing shown in the flow chart is initiated in the microprocessor of the control unit 35. First of all, at step 201, a produced signal $S_L$ is identified in order to ascertain a kind of auxiliary equipment required to operate. Then, an increment $\Delta T_i$ of fuel corresponding to the identified signal $S_L$ is retrieved in a table at step 203. It is to be noted that in this flow chart the amount of fuel is represented in the form of a time duration $T_i$ or $\Delta T_i$ in which the valve of the injector 13 is opened.

At step 205, a corrected amount $T_i'$ of fuel is obtained by adding the retrieved increment $\Delta T_i$ to the amount $T_i$ already determined just before the signal $S_L$ occurs. At step 207, the corrected amount $T_i'$ of fuel is output to the injector 13 as the fuel supply signal $P_F$, whereby the injector 13 injects fuel of the amount corresponding to the signal $P_F$.

After the signal $P_F$ is output, a timer, which is included in the microprocessor and has a time constant $T_1$, is set at step 209. It is judged at step 211 whether or not time $T_1$ has lapsed. When time $T_1$ has lapsed, the timer is turned off to produce an output signal. After that, the air increment signal $S_A$ is retrieved in a table on the basis of the increment $\Delta T_i$ of fuel obtained at step 203, and the signal $S_A$ is output to the solenoid coil 11 at step 215. The by-pass valve 9 is opened so that air of the amount according to the signal $S_A$ is introduced through the by-pass 7, in addition to air sucked through the throttle valve 3.

With the increase of fuel and air as mentioned above, the engine increases its output power. Therefore, even if the auxiliary equipment required is effectively operated, the number of revolutions of the engine is never decreased, because the engine already increases its output power commensurate with the increased load.

Further, the reason why there is provided a time difference $T_1$ between the output of the signal $P_F$ and that of the signal $S_A$ is as follows. Generally, the delay in the transportation to the combustion chamber 17 is larger in fuel than in air. Namely, although air reaches the combustion chamber 17 in a short time after the valve 9 is opened, it takes longer time until the injected fuel reaches the combustion chamber 17. If, therefore, fuel is at first increased and at a predetermined time thereafter, in general several hundred milliseconds later, air is increased, then both reach the combustion chamber 17 almost at the same time, and therefore, it never occurs that the fuel mixture becomes too lean even temporarily.

By the way, there is observed a remarkable influence of the transportation delay, as mentioned above, especially on an engine of the SPI type as in the present embodiment, because the distance between the injector 13 and the combustion chamber 17 is considerably large. 0n the other hand, in an engine of the type, in which injectors are equipped near respective cylinders as in the MPI type, time $T_1$ may be unnecessary, or sufficient with a very small value. In this manner, the provision of time $T_1$ depends upon the type of engine to which the present invention is applied.

As already described, air reaches the combustion chamber 17 almost without a time delay. Therefore, immediately after the signal $S_A$ is output, the auxiliary equipment can be actuated. However, in order to further ensure the stable operation of the engine, the following control further takes place in the present embodiment.

The operational condition of the engine is judged at step 217, i.e., it is judged whether or not the throttle valve 3 is in the idle opening condition. This judgment can be carried out by judging whether or not the value of the signal $\alpha$ from the throttle sensor 5 is larger than a predetermined value. Further, it can also be judged by observing whether or not an idle switch, which is often equipped to a throttle valve and detects that the throttle valve is in the idle position, is operated.

If the throttle valve 3 is in the idle opening condition, this fact means that the engine is in the idling state. In this case, the number N of revolutions of the engine is input at step 219 and it is judged at step 221 whether or not N is larger than a predetermined value $N_a$. If N is equal to or larger than $N_a$, the signal L is produced to the electromagnetic clutch 33 at step 223. If N is smaller than $N_a$, then the production of the signal L is awaited until N reaches $N_a$.

Returning to step 217, if the throttle valve 3 is not in the idle opening condition, the engine is regarded as operating at a certain number of revolutions larger than that of the idling state. At that time, another timer, which is also included in the microprocessor and has a time constant $T_2$, is set at step 225, and it is judged at step 227 whether or not time $T_2$ has lapsed from the setting of the timer. After the timer is turned off, i.e., when time $T_2$ has lapsed, the signal L is produced at step 223.

Figure 3A:
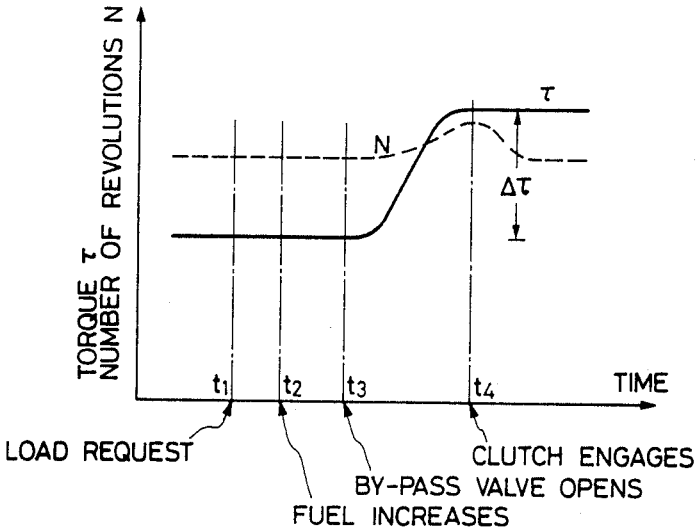
FIGS. 3*a* and 3*b* are diagrams showing the change of torque produced by an engine and a number of revolutions thereof in an invention apparatus and a prior art apparatus, respectively.
Figure 3B:
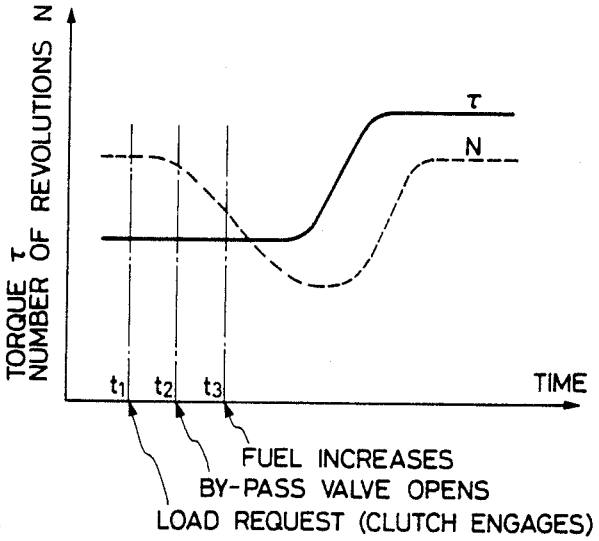
FIG. 3b PRIOR ART

In the following, the effect of the present invention will be made clear with reference to FIGS. 3*a* and 3*b*, in which FIG. 3*a* shows the changing manner of torque $\tau$ produced by an engine and the number N of revolutions thereof, when the engine is controlled in accordance with the present invention. Further, those according to the prior art apparatus are shown in FIG. 3*b* for the purpose of the comparison.

Let us assume that the switch 37 for a car air conditioner is turned on at time point $t_1$, i.e., a load request to the engine occurs at that time. In accordance with the invention, at time point $t_2$ in FIG. 3*a*, fuel supplied for the engine is increased by the amount corresponding to the air conditioner load. After that, at time point $t_3$, the by-pass valve 9 is opened and additional air commensurate with the increment of fuel is introduced into the engine. The time interval between $t_2$ and $t_3$ corresponds to the time constant $T_1$ of the timer, as already described.

In the meantime, the electromagnetic clutch 33 is not engaged and therefore there is no increase in the load put on the engine. Accordingly, although the torque $\tau$ produced by the engine does not increase, the number N of revolutions thereof also does not change.

When the fuel and air reach the engine, the torque $\tau$ increases and also the number of revolutions increases accordingly. At time point $t_4$, when the torque $\tau$ of the engine is increased sufficiently, an actuating signal L is given to the electromagnetic clutch 33, which is engaged in response thereto. The increment $\Delta\tau$ of the torque is consumed by the air conditioner, and the number N of revolutions is returned to a predetermined value.

If the amounts of the increments of fuel and air are properly selected and the timings of supplying the increased fuel and air and producing the actuating signal L are adequately set, the increase of the number N of revolutions of the engine can be suppressed as much as possible.

On the other hand, as apparent from FIG. 3*b*, an electromagnetic clutch in the prior art apparatus is engaged simultaneously with the occurrence of the load request. As a result, the number N of revolutions of the engine is greatly decreased, since the increased load is put on the engine before it increases its output power sufficiently. After a by-pass valve is opened at time point $t_2$ and fuel is increased at time point $t_3$, the number N of revolutions is recovered as the torque $\tau$ increases.

As apparent from the comparison of both figures, the invention produces no recessed portion in the change of the number N of revolutions, which is apt to cause unstable operation of the engine.

We claim:

1. A fuel supply control apparatus for an internal combustion engine, having:

suction air amount control means for supplying a predetermined amount of air for the engine;

fuel supply means for supplying a predetermined amount of fuel in response to a fuel supply signal;

additional air amount control means for supplying a predetermined amount of additional air for the engine by by-passing said suction air amount control means;

engine speed detecting means for detecting a number of revolutions of the engine and producing a number-of-revolution signal in proportion thereto;

control unit means for executing a predetermined processing on the basis of an air amount signal representative of the amount of the air supplied by said suction air amount control means and the number-of-revolution signal to produce the fuel supply signal; and switch means, which is manipulated when auxiliary equipment of a car is required to be operated, for producing a load request signal corresponding to the auxiliary equipment required to be operated;

wherein said control unit means includes microprocessor means for executing a processing operation comprising the following steps:

(a) identifying the kind of auxiliary equipment required to be operated on the basis of the load request signal;

(b) retrieving a value of an amount of an increment of fuel in a table prepared in advance within said control unit means on the basis of the identified kind of the auxiliary equipment;

(c) correcting the amount of fuel represented by the fuel supply signal in accordance with the retrieved value of the incremental amount of fuel and outputting a corrected fuel supply signal to said fuel supply means;

(d) retrieving a value of an amount of additional air in a table prepared in advance within said control unit means on the basis of the incremental amount of fuel and outputting an air increment signal representative of the retrieved value of the amount of additional air to said additional air amount control means at a predetermined time after the corrected fuel supply signal is produced to said fuel supply means; and (e) producing an actuating signal for actuating the auxiliary equipment required to be operated after the air increment signal is produced.

2. A fuel supply control apparatus as defined in claim 1, wherein the actuating signal is output to the auxiliary equipment required to be operated, when the number of revolutions of the engine becomes larger than a predetermined value.

3. A fuel supply control apparatus as defined in claim 1, wherein the actuating signal is output to the auxiliary equipment required to be operated at a predetermined time after the air increment signal is output to said additional air amount control means.

4. A fuel supply control apparatus for an internal combustion engine, having:

suction air amount control means for supplying a redetermined amount of air for the engine;

fuel supply means for supplying a predetermined amount of fuel in response to a fuel supply signal;

additional air amount control means for supplying a predetermined amount of additional air for the engine by by-passing said suction air amount control means;

engine speed detecting means for detecting a number of revolutions of the engine and producing a number-of-revolution signal in proportion thereto;

control unit means for executing a predetermined processing on the basis of an air amount signal representative of the amount of the air supplied by said suction air amount control means and the number-of-revolution signal to produce the fuel supply signal; and switch means, which is manipulated when auxiliary equipment of a car is required to be operated, for producing a load request signal corresponding to the auxiliary equipment required to be operated;

wherein said control unit means includes microprocessor means for executing a processing operation comprising the following steps:

(a) identifying the kind of auxiliary equipment required to be operated on the basis of the load request signal;

(b) retrieving a value of an amount of an increment of fuel in a table prepared in advance within said control unit means on the basis of the identified kind of the auxiliary equipment;

(c) correcting the amount of fuel represented by the fuel supply signal in accordance with the retrieved value of the incremental amount of fuel and outputting a corrected fuel supply signal to said fuel supply means;

(d) retrieving a value of an amount of additional air in a table prepared in advance within said control unit means on the basis of the incremental amount of fuel and outputting an air increment signal representative of the retrieved value of the amount of additional air to said additional air amount control means; and (e) producing an actuating signal for actuating the auxiliary equipment required to be operated when the number of revolutions of the engine becomes larger than a predetermined value.

5. A fuel supply control apparatus for an internal combustion engine comprising:

suction air amount control means for supplying a predetermined amount of air for the engine;

fuel supply means for supplying a predetermined amount of fuel in response to a fuel supply signal;

additional air amount control means, responsive to an air increment signal, for supplying a predetermined amount of additional air for the engine in addition to the air supplied by said suction air amount control means;

engine speed detecting means for detecting the number of revolutions of the engine;

switch means, which is manipulated when auxiliary equippment is required to be operated, for producing a load request signal corresponding to the auxiliary equipment required to be operated; and control unit means for producing the fuel supply signal in response to the amount of the air supplied by said suction air amount control means and the number of revolutions detected by said engine speed detecting means, said control unit means including means for executing the following steps:

(a) determining an amount of an increment of fuel on the basis of the load request signal;

(b) correcting the fuel supply signal in accordance with the determined incremental amount of fuel and outputting a corrected fuel supply signal to said fuel supply means;

(c) determining an amount of additional air on the basis of the incremental amount of fuel and outputting an air increment signal at a predetermined time after output of the corrected fuel supply signal; and (d) producing an actuating signal for actuating the auxiliary equipment required to be operated after the air increment signal is produced.

6. A fuel supply control apparatus as defined in claim 5, wherein said actuating signal is output to the auxiliary equipment required to be operated, when the number of revolutions of the engine is larger than a predetermined value.

7. A fuel supply control apparatus as defined in claim 5, wherein the actuating signal is output to the auxiliary equipment required to be operated at a predetermined time after occurrence of the air increment signal.

* * * * *